US010371020B2

(12) United States Patent
Altherr et al.

(10) Patent No.: US 10,371,020 B2
(45) Date of Patent: Aug. 6, 2019

(54) INTERNAL COMBUSTION ENGINE

(71) Applicant: Mahle International GmbH, Stuttgart (DE)

(72) Inventors: Patrick Altherr, Stuttgart (DE); Hermann Hoffmann, Filderstadt (DE)

(73) Assignee: Mahle International GmbH (DE)

( * ) Notice: Subject to any disclaimer, the term of this patent is extended or adjusted under 35 U.S.C. 154(b) by 103 days.

(21) Appl. No.: 15/620,739

(22) Filed: Jun. 12, 2017

(65) Prior Publication Data

US 2017/0362967 A1 Dec. 21, 2017

(30) Foreign Application Priority Data

Jun. 15, 2016 (DE) ..... 10 2016 210 679

(51) Int. Cl.

| | |
|---|---|
| ***F01L 1/34*** | (2006.01) |
| ***F01L 1/44*** | (2006.01) |
| ***F01L 1/047*** | (2006.01) |
| ***F01L 1/18*** | (2006.01) |
| ***F01L 1/344*** | (2006.01) |
| ***F01L 1/053*** | (2006.01) |

(Continued)

(52) U.S. Cl.

CPC ..... *F01L 1/44* (2013.01); *F01L 1/047* (2013.01); *F01L 1/053* (2013.01); *F01L 1/18* (2013.01); *F01L 1/181* (2013.01); *F01L 1/344* (2013.01); *F01L 13/0005* (2013.01); *F01L 13/0036* (2013.01); *F01L 1/267* (2013.01); *F01L 2013/0052* (2013.01); *F01L 2105/00* (2013.01)

(58) Field of Classification Search

CPC ..... F01L 1/047; F01L 1/18; F01L 1/44; F01L 1/181; F01L 1/267; F01L 13/0005; F01L 2013/0052

USPC ..... 123/90.16, 90.6, 90.18, 90.39, 90.44

See application file for complete search history.

(56) References Cited

U.S. PATENT DOCUMENTS

| | | | |
|---|---|---|---|
| 3,520,287 | A | 7/1970 | Calvin |
| 6,293,238 | B1 | 9/2001 | Harmon |

(Continued)

FOREIGN PATENT DOCUMENTS

| | | | |
|---|---|---|---|
| DE | 4327490 | A1 | 2/1995 |
| DE | 19853392 | A1 | 5/2000 |
| DE | 10014320 | A1 | 11/2000 |

(Continued)

OTHER PUBLICATIONS

English Abstract for JP-H06101432A.

(Continued)

*Primary Examiner* — Ching Chang

(74) *Attorney, Agent, or Firm* — Fishman Stewart PLLC

(57) ABSTRACT

An internal combustion engine may include at least one cylinder, a first outlet valve and a second outlet valve for directing exhaust gas out from a combustion chamber of the at least one cylinder. The first outlet valve may include a first valve opening and a first valve body where the first valve opening is adjustable between a closed position and an open position. The second outlet valve may include a second valve opening and a second valve body where the second valve body is adjustable between a closed position and an open position. An adjusting lever may adjust one or both of the first valve body and the second valve body between the open position and the closed position.

20 Claims, 4 Drawing Sheets

(51) Int. Cl.
*F01L 13/00* (2006.01)
*F01L 1/26* (2006.01)

(56) References Cited

U.S. PATENT DOCUMENTS 6,386,160 B1 5/2002 Meneely et al.
9,528,398 B2 * 12/2016 Jeon ..... F01L 1/2411
123/90.39

FOREIGN PATENT DOCUMENTS

DE 19945340 A1 3/2001
DE 19945525 A1 3/2001
JP H06101432 A 4/1994

OTHER PUBLICATIONS

English Abstract for DE-4327490.
English Abstract for DE-19945525.
English Abstract for DE-19945340.
English Abstract for DE-19853392.

* cited by examiner

INTERNAL COMBUSTION ENGINE

CROSS-REFERENCE TO RELATED APPLICATION

This application claims priority to Germany Patent Application No. 10 2016 210 679.1, filed on Jun. 15, 2016, the contents of which are hereby incorporated by reference in its entirety.

TECHNICAL FIELD

The invention relates to an internal combustion engine.

BACKGROUND

Internal combustion engines with several cylinders can have several outlet valves for each cylinder, by means of which the exhaust gas generated in the combustion chamber, delimited by the respective cylinder, can be directed out from the combustion chamber in a synchronized manner. For this, the available outlet valves are adjustable respectively between an open position and a closed position. In the closed position, a valve body of the respective outlet valve closes a valve opening, associated therewith, and in the open position the valve body frees the valve opening for flowing through by exhaust gas.

It often proves to be a problem here that precisely during opening of the outlet valves, owing to the high gas pressure of the exhaust gas which is generated in the combustion chambers, very great forces can act on the valve bodies. These forces lead to a high mechanical stress in particular of the components which are provided for controlling the valve bodies, such as for instance an adjusting lever for adjusting the valve bodies, or a valve train for controlling said adjusting lever.

It is therefore an object of the present invention to provide an improved embodiment of an internal combustion engine, in which the above-mentioned problems are eliminated or at least only still occur in reduced form.

This problem is solved by the subject matter of the independent claims. Preferred embodiments are the subject of the dependent claims.

SUMMARY

A fundamental idea of the invention is, accordingly, to construct a first and a second outlet valve for directing exhaust gas out from the combustion chamber of an internal combustion engine such that after the adjusting of a first valve body of the first outlet valve by a predetermined adjustment travel away from a closed position, the second valve body of the second outlet valve still closes the second valve opening.

In this way, the forces acting on the valve bodies by the exhaust gas in the combustion chamber can be reduced. This also leads to a reduction of the mechanical stress on the components which are provided for controlling the valve bodies, such as for instance the adjusting lever for adjusting the valve bodies, or the valve train for controlling the adjusting lever. As a result, the risk of damage to the internal combustion engine, in particular of the said components, is therefore considerably reduced.

An internal combustion engine according to the invention comprises at least one cylinder, in which a combustion chamber is present. Furthermore, the internal combustion engine comprises a first outlet valve and a second outlet valve for directing exhaust gas out from the combustion chamber of the cylinder. The first outlet valve comprises a first valve opening and a first valve body. The first valve body is adjustable here between a closed position, in which it closes the valve opening, and an open position, in which it frees the valve opening for flowing through by the exhaust gas. Accordingly, the second outlet valve comprises a second valve opening and a second valve body. The second valve body is adjustable between a closed position, in which it closes the second valve opening, and an open position, in which it frees the valve opening for flowing through by the exhaust gas. The internal combustion engine further comprises a shared adjusting lever, rotatable about a rotation axis, by means of which the two valve bodies are adjustable simultaneously between their respective open position and their respective closed position. According to the invention, the two valve bodies are constructed such that after the adjusting of the first valve body by a predetermined adjustment travel away from its closed position, the second valve body still closes the second valve opening.

In a preferred embodiment, the predetermined adjustment travel is between 0.1 mm and 0.5 mm. Experimental investigations have shown that in this way a particularly high load removal of the adjusting lever and therefore also of a valve train cooperating with the adjusting lever can be achieved, without this involving output losses in the internal combustion engine. In variants of this embodiment, other values are also conceivable for the predetermined adjustment travel.

For a particularly simple technical realization of the time-delayed opening of the two outlet valves, which is essential to the invention, it is proposed according to a further preferred embodiment to realize the two outlet valves such that the second valve body in the closed position of the first outlet valve projects deeper into the second valve opening than the first valve body into the first valve opening. When both valve bodies are moved out from the valve openings, the second valve body is still arranged in the second valve opening, when the first valve body is already situated outside the first valve opening, so that the principle of time-delayed opening of the two outlet valves, which is essential to the invention, is implemented.

In an alternative simple technical realization of the time-delayed opening of the two outlet valves, which is essential to the invention, it is proposed according to another preferred embodiment to arrange the second valve body in the open position of the two outlet valves at a smaller distance relative to the second valve opening than the first valve body relative to the first valve opening. Said distance can be measured here respectively along a direction perpendicular to an opening plane defined by the respective valve opening. When both valve bodies are moved away from the valve openings, the second valve body is thus still arranged at the second valve opening when the first valve body is already situated at a distance from the first valve opening, so that also the principle of time-delayed opening of the two outlet valves, which is essential to the invention, is implemented.

Particularly expediently, the distance difference of the two valve bodies in the open position corresponds substantially to the predetermined adjustment travel. This makes it possible to realize the time-delayed opening of the two outlet valves, which is essential to the invention, in a technically simple manner.

In a further preferred embodiment, the first valve body has a first body height and the second valve body has a second body height. In this variant, the second body height is greater than the first body height. This variant also makes it possible to realize the time-delayed opening of the two outlet valves, which is essential to the invention, in a technically simple manner.

In an advantageous further development, the two valve bodies have respectively substantially the geometry of a cylinder with a first or respectively a second cylinder height. In this further development, the second cylinder height is greater than the first cylinder height. This embodiment also permits the time-delayed opening of the two outlet valves, which is essential to the invention, to be realized.

Particularly preferably, the difference of the two body heights, in particular of the two cylinder heights, corresponds substantially to the amount of the predetermined adjustment travel.

In another preferred embodiment, the two valve bodies have respectively substantially identical body heights, in particular substantially identical cylinder heights. In this embodiment, the two valve bodies, in particular the two cylinders, are arranged on the adjusting lever, offset axially to one another by the predetermined adjustment travel. This variant permits the two valve bodies to be manufactured and used as identical parts.

Expediently, the rotation axis of the adjusting lever can run parallel to a rotation axis of the cam follower roller and/or to a rotation axis of the camshaft. Such an embodiment is particularly compact in construction.

Particularly preferably, the adjusting lever has a first lever arm, on which the two valve bodies are arranged. Furthermore, in this variant, the adjusting lever has a second lever arm, on which the cam follower base body is arranged.

In an advantageous further development, the internal combustion engine has a valve train for driving the adjusting lever. According to this advantageous further development, the valve train comprises a camshaft and a cam follower which is drivingly connected with the adjusting lever. Furthermore, a first cam, mounted in a torque-proof manner on the camshaft, and a second cam, arranged in a torque-proof manner and axially adjacent to the first cam, are provided. Here, the cam follower is axially adjustable between a first position, in which it is drivingly connected with the first cam, and a second position, in which it is drivingly connected with the second cam.

Particularly expediently, the cam follower can have a cam follower base body rigidly connected with the adjusting lever, and a roller, mounted rotatably on the cam follower base body. In the first position of the cam follower, this roller is drivingly connected with the first cam, and in the second position of the cam follower it is drivingly connected with the second cam. The cam follower base body is also known under term "roller pin" to the relevant specialist in the art.

Further important features and advantages of the invention will emerge from the subclaims, from the drawings and from the associated figure description with the aid of the drawings.

It shall be understood that the features mentioned above and to be explained further below are able to be used not only in the respectively indicated combination, but also in other combinations or in isolation, without departing from the scope of the present invention.

Preferred example embodiments of the invention are illustrated in the drawings and are explained further in the following description, wherein the same reference numbers refer to identical or similar or functionally identical components.

BRIEF DESCRIPTION OF THE DRAWINGS

There are shown, respectively diagrammatically.

DETAILED DESCRIPTION

Figure 1:
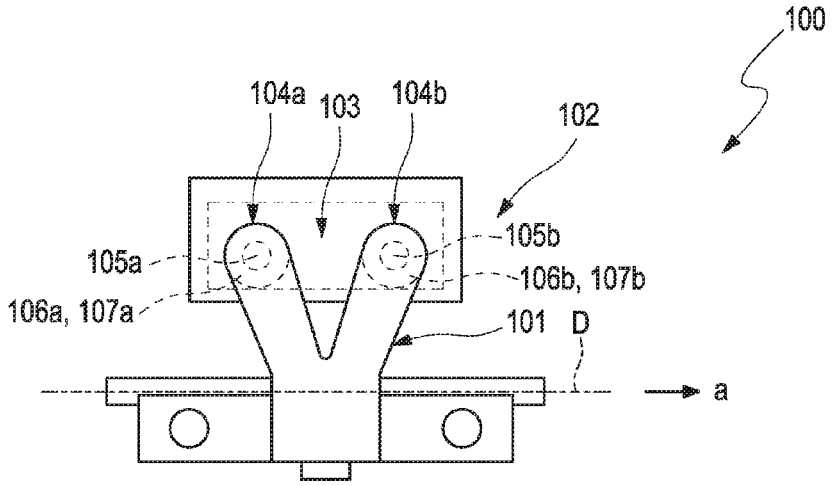
FIG. 1 the structure of an internal combustion engine according to the invention, FIG. 2 the internal combustion engine of FIG. 1 in a top view, FIGS. 3 to 6 the two outlet valves in different positions between their respective open and closed position, FIGS. 7 and 8 the structure and mode of operation of a valve train of the internal combustion engine for actuating the outlet valves.

FIG. 1 illustrates in a rough diagrammatic illustration the structure of an internal combustion engine 100 according to the invention. The internal combustion engine 100 comprises a cylinder 102, indicated roughly diagrammatically in FIG. 2. The internal combustion engine can have further cylinders, not illustrated in further detail in the figures, which can be constructed in an analogous manner to the cylinders illustrated with the aid of the figures. A combustion chamber 103 is present in the cylinder 102.

According to FIG. 1, the internal combustion engine 100 furthermore comprises a first outlet valve 104*a* and a second outlet valve 104*b* for directing exhaust gas out from the combustion chamber 103 of the cylinder 102. The first outlet valve 104*a* comprises a first valve opening 105*a* and a first valve body 106*a*. The first valve body 106*a* is adjustable between a closed position, in which it closes the first valve opening 105*a*, and an open position, in which it frees the first valve opening 105*a* for flowing through by the exhaust gas. The second outlet valve 104*b* comprises a second valve opening 105*b* and a second valve body 106*b*. The second valve body 6*b* is adjustable between a closed position, in which it closes the second valve opening 105*b*, and an open position, in which it frees the valve opening 105*b* for flowing through by the exhaust gas.

Further technical details of the internal combustion engine 100, such as for example inlet valves for directing fresh or respectively charge air into the cylinder 102, and a piston arranged adjustably in the combustion chamber 103, are known to the relevant specialist in the art and are not the focus of the present invention and therefore, for reasons of clarity, are not illustrated in FIG. 1.

As the illustration of FIG. 1 directly shows, the internal combustion engine 100 has an adjusting lever 101 which is rotatable about a rotation axis D. By means of the adjusting lever 101, the two valve bodies 106*a*, 106*b* can be adjusted simultaneously between their respective open position and their respective closed position. An axial direction a is defined here by the rotation axis D of the adjusting lever 101.

Figure 2:
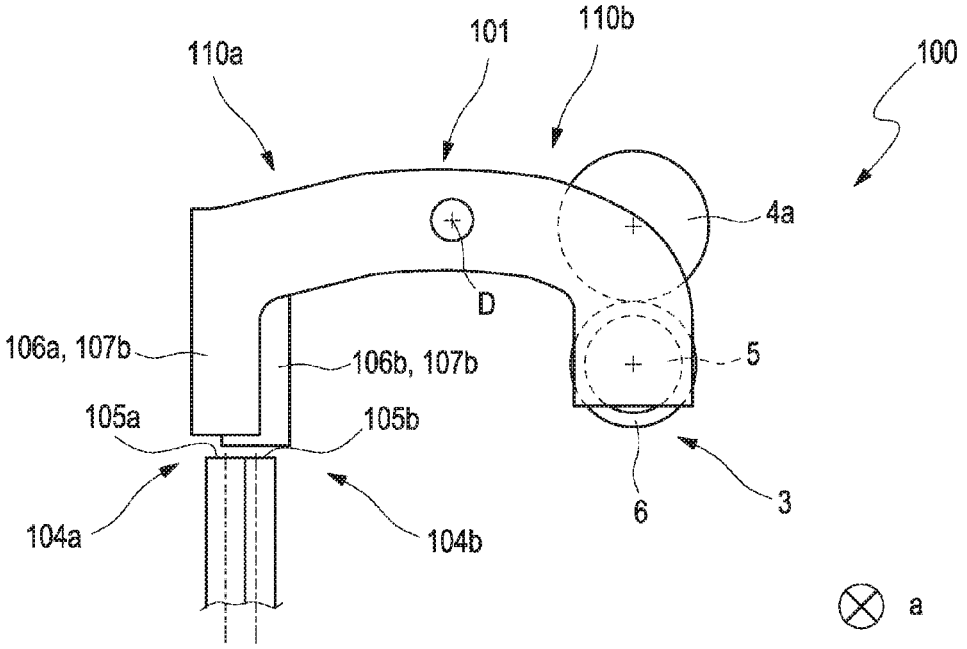

FIG. 2 shows the internal combustion engine 100 of FIG. 1 in a top view along the axial direction a. As evidenced by FIG. 2, the two valve bodies 106*a*, 106*b* can have respectively substantially the geometric shape of a cylinder 107*a*, 107*b*.

Figure 3:
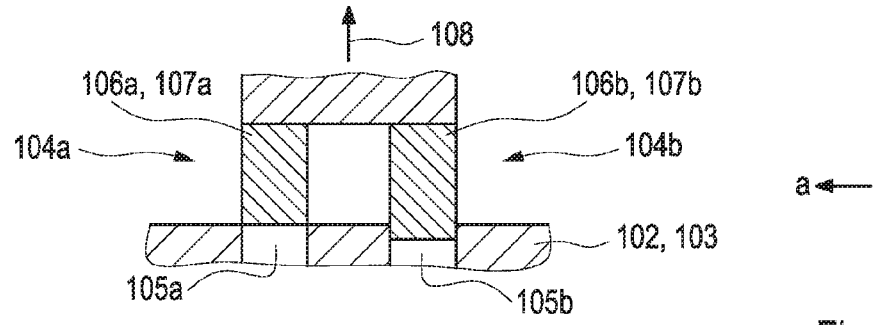

The two valve bodies 106*a*, 106*b* of the internal combustion engine 100 are constructed such that after the adjusting of the first valve body 106*a* by a predetermined adjustment travel s away from its closed position, the second valve body 106*b* still closes the second valve opening 105*b*. This characteristic of the two valve bodies 106*a*, 106*b*, which is essential to the invention, is explained below with the aid of FIGS. 3 to 6:

FIG. 3 shows in a highly simplified, diagrammatic illustration the two outlet valves 104*a*, 104*b* in their respective closed position, in which the two valve openings 105*a*, 105*b* are closed by the respectively associated valve bodies 106*a*,

106*b*. The two valve bodies 106*a*, 106*b*, as indicated in FIGS. 3 to 6, can have respectively substantially the geometric shape of a cylinder 107*a*, 107*b*. The valve bodies 106*a*, 106*b* can have, in a known manner, a valve shaft, which towards the cylinder 102 of the internal combustion engine 100 continues into a valve plate with an increased diameter compared to the valve shaft. For reasons of clarity, such a structural embodiment of the valve bodies 106*a*, 106*b* is not illustrated in FIGS. 3 to 6.

Through a movement of the adjusting lever 101 (the latter is likewise not shown in FIGS. 3 to 6 for reasons of clarity), the two valve bodies 105*a*, 105*b* are moved away from the valve openings 106*a*, 106*b* (cf. arrow 108 in FIG. 3). The movement of the first valve body 106*a* brings about an immediate freeing of the first valve opening 106, whereas the second valve opening 105*b* still remains closed by the second valve body 106*b*.

Figure 4:
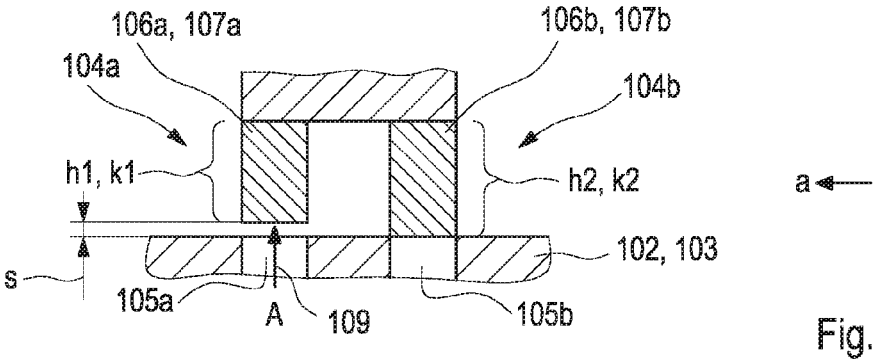
Figure 5:
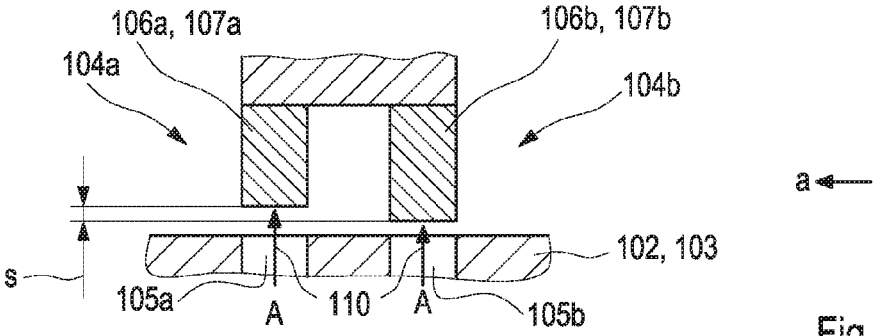

FIG. 4 shows a position of the two outlet valves 104*a*, 104*b*, in which as a consequence of this movement, the first valve body 106*a* of the first outlet valve 104*a* was moved by the predetermined adjustment travel away from the closed position shown in FIG. 3. The second valve body 106*b* of the second outlet valve 104*b* was also adjusted by means of the control lever 101 by the same predetermined adjustment travel s, but in the position shown in FIG. 4—just as in the position according to FIG. 3—still closes the second valve opening 105*b*. This predetermined adjustment travel s can be, for example, between 0.1 mm and 0.5 mm. However, other values are also conceivable, according to application-specific requirements.

Figure 6:
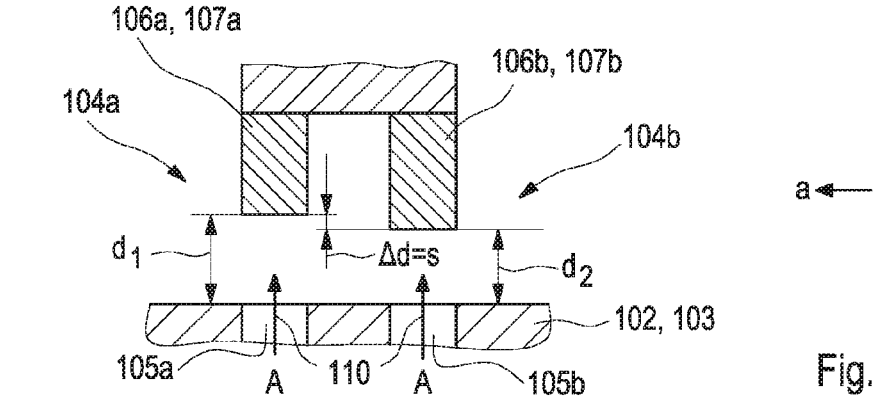

In the position of the two valve bodies 106*a*, 106*b* according to FIG. 4, exhaust gas A can therefore exit from the combustion chamber 103 through the first outlet valve 104*a* (cf. arrow 109 in FIG. 4), but not through the second outlet valve 104*b*. Only a further moving of the control lever 101 and a movement, accompanying this, of the two valve bodies 106*a*, 106*b* beyond the predetermined adjustment travel also brings about a freeing of the second valve opening 105*b* by the second valve body 106*b*, so that exhaust gas A can now exit from the combustion chamber 103 both through the first outlet valve 104*a* and also through the second outlet valve 104*b* (arrows 110). The two valve bodies 106*a*, 106*b* can be adjusted into their open position by further adjusting of the control lever 101, in which they are adjusted to a maximum extent away from their closed position. The diagrammatic illustration of FIG. 6 shows the open position of the two outlet valves 104*a*, 104*b*.

In the open position of the two outlet valves 104*a*, 104*b*, a distance $d_2$ of the second valve body 106*b* to the second valve opening 105*b* is less than a distance $d_1$ of the first valve body 16*a* to the first valve opening 105*a*.

The distance difference $\Delta d = d_1 - d_2$ of the two valve bodies 106*a*, 106*b* in the open position to the respective valve opening 105*a*, 105*b* corresponds substantially to the predetermined adjustment travel s, therefore $\Delta d = s$.

As the illustration of FIG. 4 shows, to realize the distance difference $\Delta d$ a second cylinder height $h_2$ of the second cylindrical valve body 106*b* can be greater than a first cylinder height $h_1$ of the first cylindrical valve body 106*a*. In this case, the difference of the two cylinder heights $h_1$, $h_2$ corresponds substantially to the amount of the predetermined adjustment travel s. The same principle can be followed to realize the distance difference $\Delta d$, when the two valve bodies 106*a*, 106*b* do not have a cylindrical shape, but rather a different suitable geometric shape with a first and a second body height k1, k2, which is measured along a direction which runs perpendicularly to an opening plane of the respective valve opening 105*a*, 105*b*. In this more general case, the difference of the two body heights $k_1$, $k_2$ corresponds substantially to the amount of the predetermined adjustment travel s.

In an alternative variant, which is not shown in FIGS. 3 to 6, the two valve bodies 106*a*, 106*b* can have respectively substantially the geometry of a cylinder with identical cylinder heights $h_1$, $h_2$, therefore $h_1 = h_2$. In order to ensure that also in this case, after the adjusting of the first valve body 106*a* by the predetermined adjustment travel s away from its closed position, the second valve body 106*b* is still situated in its closed position, the two cylindrical valve bodies 106*a*, 106*b* with the same cylinder heights $h_1$, $h_2$ are arranged, axially offset to one another by the predetermined adjustment travel s, on the adjusting lever 101.

The offset opening of the two outlet valves 104*a*, 104*b* or respectively of the two valve openings 105*a*, 105*b*, which is essential to the invention, can also be realized in a further variant with identically constructed valve bodies 106*a*, 106*b*, when the second valve body 106*b* in the closed position of the first outlet valve 104*a* projects deeper into the second valve opening 105*b* than the first valve body 1056*a* into the first valve opening 105*a* (not shown in the figures). With a simultaneous movement of the two valve bodies 106*a*, 106*b*, the second valve opening 105*b* is freed only later than the first valve opening 105*a*, so that also in this variant the opening of the two outlet valves 104*a*, 104*b* takes place offset to one another.

Figure 7:
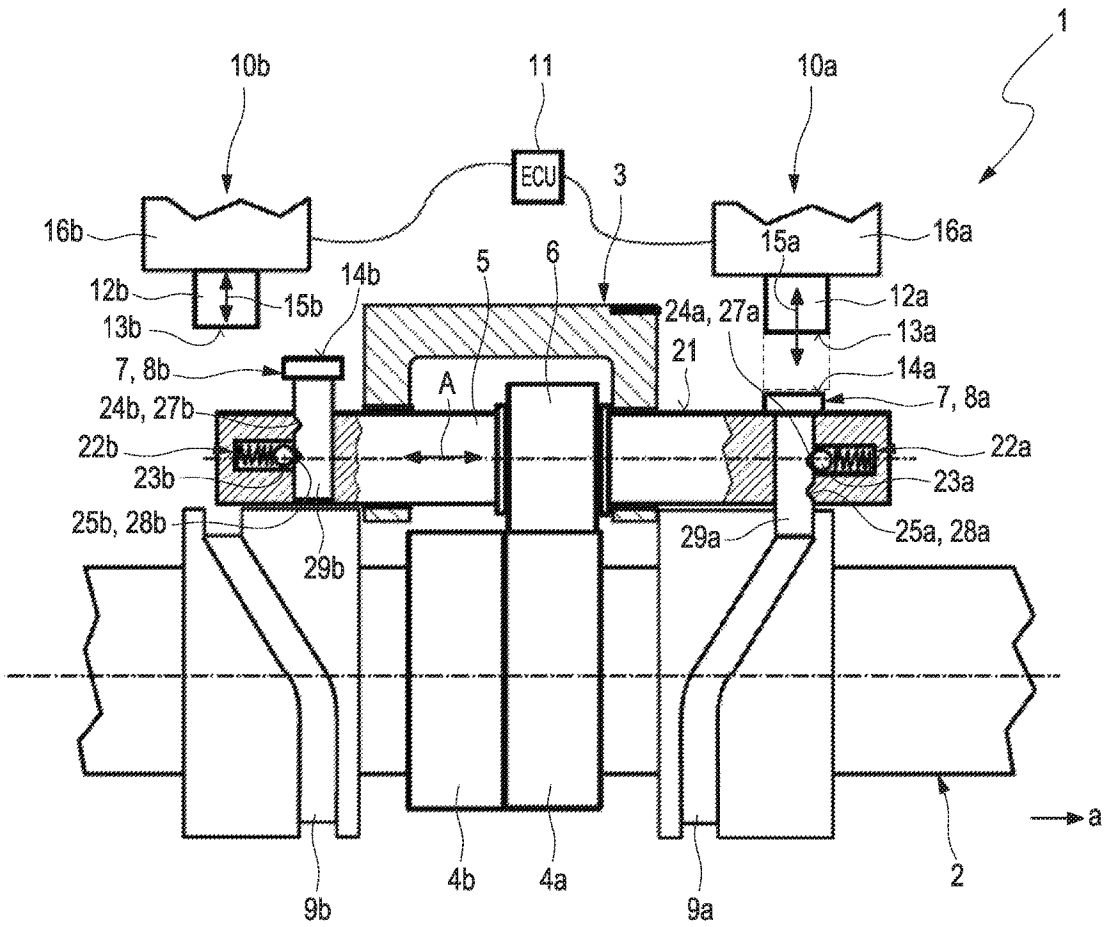
Figure 8:
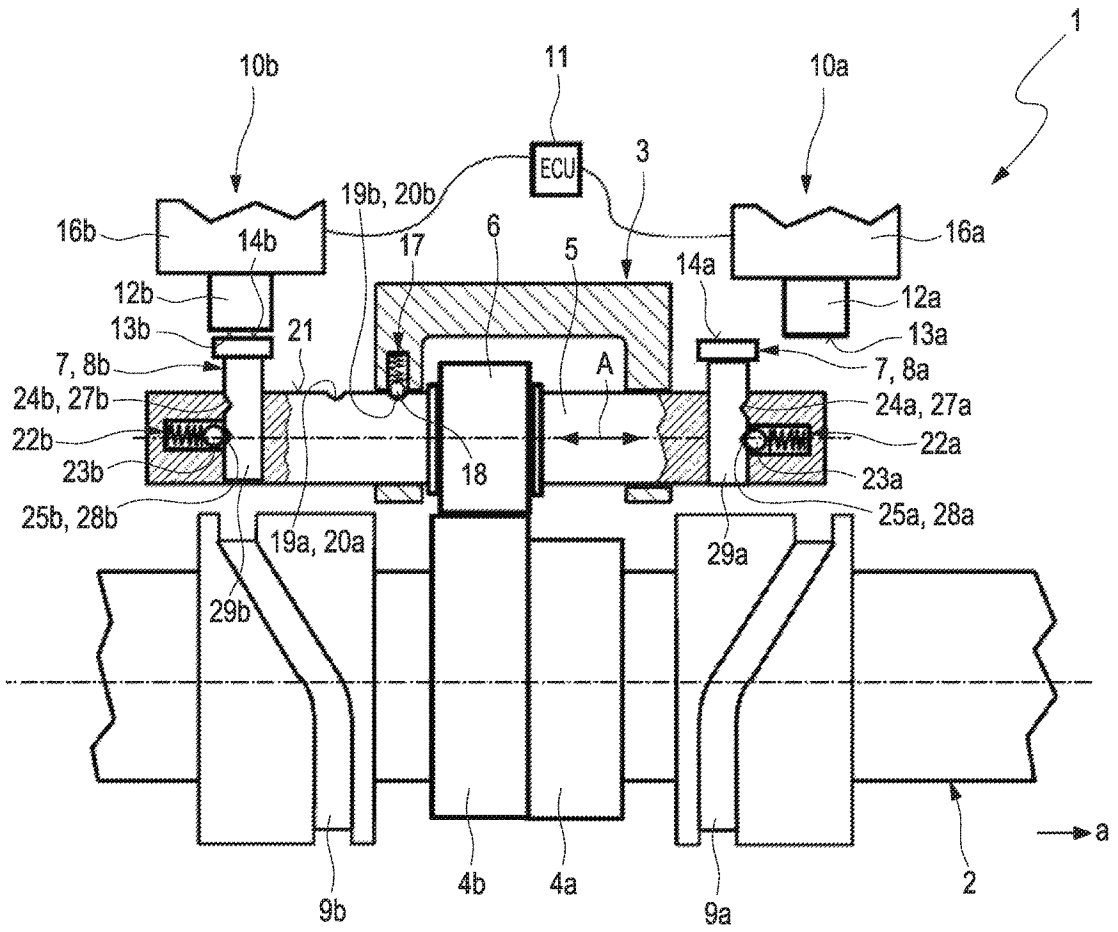

FIGS. 7 and 8 illustrate in diagrammatic illustration an example of a valve train 1 of the internal combustion engine 100 for controlling the adjusting lever 101. The valve train 1 comprises a camshaft 2 and a cam follower 3. A first cam 4*a* is mounted in a torque-proof manner on the camshaft 2. Axially adjacent to the first cam 4*a*, a second cam 4*b* is arranged on the camshaft 2, likewise in a torque-proof manner with respect thereto.

The cam follower 3 adjustable along the axial direction a between a first position, in which it is drivingly connected with the first cam 4*a*, and a second position, in which it is drivingly connected with the second cam 4*b*. FIG. 7 shows the cam follower 3 in said first position, FIG. 8 shows the cam follower 3 in its second position. The cam follower 3 can have a cylindrically constructed cam follower base body 5, on the circumferential side of which a hollow-cylindrically constructed cam follower roller 6 is rotatably mounted. The cam follower base body 5 is also known to the relevant specialist in the art under the term "roller pin" or "displacement axis." The drive connection of the two cams 4*a*, 4*b* with the cam follower 3 takes place in a known manner via the cam follower roller 6. Here, the rotary movement of the camshaft 2 is converted by means of the cams 4*a*, 4*b* into a rotary movement of the adjusting lever 101 about the rotation axis D. The rotary movement of the adjusting lever 101 is, in turn, accompanied by a movement of the outlet valves 104*a*, 104*b* between their respective open or respectively closed position.

In the first position of the cam follower 3, shown in FIG. 7, the cam follower roller 6 is coupled with the first cam 4*a*, in FIG. 2 with the second cam 4*b*. The cam follower roller 6 controls (not shown) via a suitably constructed mechanical coupling arrangement, in particular in the manner of an actuator, a valve for adjusting between an open and a closed state. Practical technical realization possibilities of such a coupling are not part of the present invention, but are known to the relevant specialist from the prior art in various forms, so that a more detailed explanation in this respect can be dispensed with.

The cam follower 3 of FIG. 7 has a mechanical adjustment arrangement 7, cooperating with the camshaft 2, for the axial adjustment of the cam follower 3 between the first and the second position. The mechanical adjustment arrangement 7 comprises for this a first adjustable mechanical engagement element 8*a*. The first mechanical engagement element 8*a* cooperates with a first slide guide 9*a*, present on the camshaft 2, for the axial adjusting of the cam follower 3 from the first position shown in FIG. 7 into the second position. In an analogous manner, the mechanical adjustment arrangement 7 has an adjustable second mechanical engagement element 8*b*. The second engagement element 8*b* cooperates with a second slide guide 9*b*, present on the camshaft 3, for the axial adjusting of the cam follower 3 from its second into the first position.

The mechanical adjustment arrangement 7 further comprises a first actuator 10*a*, by means of which the first engagement element 8*a* is adjustable between a first position, shown in FIG. 7, in which it engages into the first slide guide 9*a*, and a second position, shown in FIG. 8, in which it does not engage into the first slide guide 9*a*. The mechanical adjustment arrangement 7 also comprises a second actuator 10*b*, by means of which the second engagement element 8*b* is adjustable between a first position, in which it engages into the second slide guide 9*b*, and a second position, in which it does not engage into said second slide guide 9*b*.

The first actuator 10*a* is adjustable between an inactive position and an active position. For this purpose, the two actuators 10*a*, 10*b* can be constructed as linearly adjustable, electrically driven actuators. The mechanical adjustment arrangement 7 is realized in this case as an electromechanical adjustment arrangement. In other words, electrically driven actuators 10*a*, 10*b* are comprised here by the term "mechanical adjustment arrangement" 7.

The two actuators 10*a*, 10*b* are controllable by a control arrangement 11 of the valve train 1 for adjusting between their active position and their inactive position. This adjustability is realized such that the first actuator 10*a* in the inactive position is out of contact with the first engagement element 8*a*. In the course of an adjustment from its inactive position into its active position, the first actuator 10*a* adjusts the first engagement element 8*a* through mechanical contact from its second into its first position.

The adjustment of the first engagement element 8*a* from the first into the second position can preferably be brought about by means of the stroke movement of the cam follower 3, in particular by means of the cam follower base body 5. Here, the cam follower 3 is moved by the stroke movement brought about by the first or second cam 4*a*, 4*b* in the direction of the first actuator 10*a*. When the latter is in its active position, then through the stroke movement of the cam follower 3 and therefore of the first engagement element 8*a*, this is pressed against the first actuator 10*a* and is adjusted thereby into its second position.

In this state, the first engagement element 8*a* engages into the first slide guide 9*a*, so that the cam follower 3, owing to the rotary movement of the camshaft 2, is moved by means of the first slide guide 9*a*, arranged thereon, axially from its first into the second position. The second actuator 10*b* is also adjustable between an inactive position and an active position. This adjustability is realized such that the second actuator 10*b* in the active position is out of contact with the second engagement element 8*b*. In the course of an adjusting from its inactive position into its active position, the second actuator 10*b* adjusts the second engagement element 8*b* through mechanical contact from its second into its first position.

The adjustment of the second engagement element 8*b* from the first into the second position is preferably also brought about by means of the stroke movement of the cam follower 3, in particular by means of the cam follower base body 5. Here, the cam follower 3 is moved by the stroke movement brought about by the first or second cam 4*a*, 4*b* in the direction of the second actuator 8*b*. When the latter is in its active position, then through the stroke movement of the cam follower 3 and therefore of the second engagement 8*b*, this is pressed against the second actuator 10*b* and is therefore adjusted thereby into its second position.

In this state, the second engagement element 8*b* engages into the second slide guide 9*b*, so that the cam follower 3 owing to the rotary movement of the camshaft 2, by means of the second slide guide 9*a* arranged thereon, is moved axially from its second into the first position.

The first actuator 10*a* has a linearly adjustable (cf. arrow 15*a*) first adjustment element 12*a*. The latter can partially project from a first housing 16*a* of the first actuator 10*a* and be arranged linearly adjustably relative thereto. A face side 13*a* of the first adjustment element 12*a*, facing the first engagement element 8*a*, which can be constructed in a pin- or bolt-like manner, presses, on moving of the first engagement element 8*a* into the first slide guide 9*a*, against a face side 14*a* of the first engagement element 8*a* lying opposite the first adjustment element 12*a*. The second actuator 10*b* has a linearly adjustable (cf. arrow 15*b*) second adjustment element 12*b*. The latter can partially project from a second housing 16*b* of the second actuator 10*b* and be arranged linearly adjustably relative thereto. A face side 13*b* of the second adjustment element 12*b*, facing the second engagement element 8*b*, which can be constructed in a pin- or bolt-like manner, presses, on moving of the second engagement element 8*b* into the second slide guide 9*b*, against a face side 14*b* of the second engagement element 8*b* lying opposite the second adjustment element 12*b*.

As the illustration of FIG. 8 shows, the cam follower 3 also has a cam follower fixing arrangement 17 for the detachable fixing of the cam follower 3 in the first or second position. The cam follower fixing arrangement 17 comprises a spring-loaded cam follower fixing element 18. In the first position of the cam follower 3, the cam follower fixing element 18 engages into a first mount 19*a* provided on the cam follower 3, and in the second position of the cam follower 3 engages into a second mount 19*b* provided on the cam follower 3. Preferably, the first mount 19*a*, as illustrated in FIG. 2, is realized as a first circumferential groove 20*a*, which is arranged on a circumferential side 21 of the cam follower 3. The second mount is realized accordingly as a second circumferential groove 20*b* arranged axially at a distance on the circumferential side 21.

As FIGS. 7 and 8 clearly demonstrate, the cam follower 3 for the two engagement elements 8*a*, 8*b*, preferably for both engagement elements 8*a*, 8*b*, has respectively a first or respectively second engagement element fixing arrangement 22*a*, 22*b* for the detachable fixing of the first or respectively second engagement element 8*a*, 8*b* in the first or second position. As can be seen, the two engagement element fixing arrangements 22*a*, 22*b* have respectively a spring-loaded fixing element 23*a*, 23*b*, which in the first position of the respective engagement element 8*a*, 8*b* is received in a first mount 24*a*, 24*b* provided on the respective engagement element 8*a*, 8*b*. In the second position of the cam follower, the fixing element 23*a*, 23*b* is received in a second mount

25*a*, 25*b* provided on the cam follower. The first and the second engagement element 8*a*, 8*b* have respectively a base body 29*a*, 29*b* constructed in a bolt-like or pin-like manner. On a circumferential side of the base body 29*a*, 29*b* the first mount 24*a*, 24*b* is formed as a first circumferential groove 27*a*, 27*b*, and the second mount 25*a*, 25*b* is formed as a second circumferential groove 28*a*, 28*b* arranged axially at a distance on the circumferential side.

In the following, with the aid of the illustration of FIGS. 7 and 8, an adjusting of the cam follower 3 from the first into the second position is explained. In the scenario of FIG. 1, the cam follower 3 is situated in the first position, in which its cam follower roller 6 is drivingly connected with the first cam 4*a*.

If an adjustment of the cam follower 3 is to take place from its first into its second axial position, then the first engagement element 8*a* of the mechanical adjustment arrangement 7, as shown in FIG. 7, is brought into engagement with the first slide guide 9*a*. This takes place by means of the first electric actuator 10*a*.

The first actuator 10*a*, as already explained, is adjustable between an inactive position shown in FIG. 7 and an active position—indicated by dashed lines in FIG. 1. In the inactive position, the first actuator 10*a* is mechanically out of contact with the first engagement element 8*a*. In the course of an adjusting from its inactive position into its active position, the first actuator 10*a* adjusts the first engagement element 8*a* through mechanical contact from its second into its first position. In the first position, the first engagement element 8*a* engages into the first slide guide 9*a* (cf. FIG. 7), so that the cam follower 3 through the rotary movement of the camshaft 2 by means of the first slide guide 9*a* is moved axially from its first into its second position, which is illustrated in FIG. 2. After the bringing into engagement of the first engagement element 8*a* with the first slide guide 9*a*, the first actuator 10*a* can be moved back by the control arrangement 11 into its inactive position again.

The first slide guide 9*a*—just as the second slide guide 9*b*—can have a ramp structure, not shown in the figures, such that the first engagement element 8*a* is brought out of engagement with the first slide guide, as soon as the cam follower 3 has reached the second axial position. In this second position, the second cam 4*b* is in driving connection with the cam follower roller 6. The adjusting of the cam follower 3 from the second position back into the first position can take place by means of the second actuator 10*b*, of the second engagement element 8*b* and of the second slide guide 9*b* in an analogous manner to the transition, explained previously, from the first into the second position of the cam follower 3.

The invention claimed is:

1. An internal combustion engine, comprising:

at least one cylinder including a combustion chamber;

a first outlet valve and a second outlet valve for directing exhaust gas out from the combustion chamber of the at least one cylinder;

the first outlet valve including a first valve opening and a first valve body, wherein the first valve body is adjustable between a closed position where the first valve body closes the first valve opening, and an open position where the first valve body frees the first valve opening for flowing through by the exhaust gas;

the second outlet valve including a second valve opening and a second valve body, wherein the second valve body is adjustable between a closed position where the second valve body closes the second valve opening, and an open position where the second valve body frees the second valve opening for flowing through by the exhaust gas;

a shared, rotatable adjusting lever, wherein the first valve body and the second valve body via the shared, rotatable adjusting lever are respectively adjustable simultaneously between the open position and the closed position of the first outlet valve and the second outlet valve; and wherein the first valve body and the second valve body are constructed such that after the first valve body is adjusted by a predetermined adjustment travel away from the closed position of the first outlet valve, the second valve body still closes the second valve opening.

2. The internal combustion engine according to claim 1, wherein the predetermined adjustment travel is between 0.1 mm and 0.5 mm.

3. The internal combustion engine according to claim 2, wherein the second valve body in the closed position of the first outlet valve projects further into the second valve opening than the first valve body into the first valve opening.

4. The internal combustion engine according to claim 1, wherein the second valve body in the closed position of the first outlet valve projects deeper into the second valve opening than the first valve body into the first valve opening.

5. The internal combustion engine according to claim 4, wherein the second valve body is arranged at a distance to the second valve opening that is smaller than that of the first valve body to the first valve opening when the first outlet valve and the second outlet valve are in the open position.

6. The internal combustion engine according to claim 1, wherein in the open position of the first outlet valve and the second outlet valve, the second valve body is arranged at a smaller distance to the second valve opening than the first valve body to the first valve opening.

7. The internal combustion engine according to claim 6, wherein a distance difference of the first valve body and the second valve body to the first valve opening and the second valve opening in the open position of the first valve outlet and the second valve outlet, respectively, corresponds substantially to the predetermined adjustment travel.

8. The internal combustion engine according to claim 7, wherein the predetermined adjustment travel ranges from 0.1 mm to 0.5 mm.

9. The internal combustion engine according to claim 1, wherein the first valve body has a first body height and the second valve body has a second body height; and wherein the second body height is greater than the first body height.

10. The internal combustion engine according to claim 9, wherein the first body height is substantially identical to the second body height, and wherein the first valve body and the second valve body are arranged axially offset to one another by the predetermined adjustment travel on the shared, rotatable adjusting lever.

11. The internal combustion engine according to claim 1, wherein the first valve body and the second valve body respectively have a geometry substantially of a cylinder with a first cylinder height and a second cylinder height, respectively, and wherein the second cylinder height is greater than the first cylinder height.

12. The internal combustion engine according to claim 11, wherein a difference of the first cylinder height and the second cylinder height corresponds substantially to an amount of the predetermined adjustment travel.

13. The internal combustion engine according to claim 1, wherein the shared, rotatable adjusting lever includes a first lever arm and a second lever arm, and wherein the first valve body and the second valve body are arranged on the first lever arm, and a cam follower base body is arranged on the second lever arm.

14. The internal combustion engine according to claim 1, further comprising a valve train for driving the shared, rotatable adjusting lever, the valve train including:

a camshaft and a cam follower drivingly connected with the shared, rotatable adjusting lever;

a first cam mounted in a torque-proof manner on the camshaft and a second cam arranged in a torque-proof manner and axially adjacent to the first cam; and wherein the cam follower is axially adjustable between a first position where the cam follower is drivingly connected with the first cam, and a second position where the cam follower is drivingly connected with the second cam.

15. The internal combustion engine according to claim 14, wherein the cam follower includes a cam follower base body rigidly connected with the shared, rotatable adjusting lever, and a cam follower roller mounted rotatably on the cam follower base body, wherein the cam follower roller in the first position of the cam follower is drivingly connected with the first cam, and in the second position of the cam follower the cam follower roller is drivingly connected with the second cam.

16. The internal combustion engine according to claim 15, wherein a rotation axis of the shared, rotatable adjusting lever runs parallel to at least one of a rotation axis of the cam follower roller and a rotation axis of the camshaft.

17. The internal combustion engine according to claim 15, wherein the shared, rotatable adjusting lever includes a first lever arm and a second lever arm, and wherein the first valve body and the second valve body are arranged on the first lever arm, and the cam follower base body is arranged on the second lever arm.

18. The internal combustion engine according to claim 14, wherein a rotation axis of the shared, rotatable adjusting lever runs parallel to a rotation axis of the camshaft.

19. The internal combustion engine according to claim 1, wherein the shared, rotatable adjusting lever includes a lever arm structured and arranged to simultaneously adjust the first valve body and the second valve body.

20. An internal combustion engine, comprising:

at least one cylinder defining a combustion chamber;

a first outlet valve and a second outlet valve for directing exhaust gas out from the combustion chamber of the at least one cylinder;

the first outlet valve including a first valve opening and a first valve body, wherein the first valve body is adjustable between a closed position where the first valve body closes the first valve opening, and an open position where the first valve body frees the first valve opening for flowing through by the exhaust gas;

the second outlet valve including a second valve opening and a second valve body, wherein the second valve body is adjustable between a closed position where the second valve body closes the second valve opening, and an open position where the second valve body frees the second valve opening for flowing through by the exhaust gas;

a shared, rotatable adjusting lever including a lever arm structured and arranged to simultaneously adjust the first valve body and the second valve body respectively between the open position and the closed position of the first outlet valve and the second outlet valve;

wherein the first valve body and the second valve body are configured such that after the first valve body is adjusted by a predetermined adjustment travel away from the closed position of the first outlet valve, the second valve opening is closed by the second valve body;

wherein the second valve body in the closed position of the first outlet valve projects further into the second valve opening than the first valve body projects into the first valve opening; and wherein the second valve body is arranged at a distance to the second valve opening that is smaller than that of the first valve body to the first valve opening in the open position of the first outlet valve and the second outlet valve.

* * * * *